US006592009B2

(12) United States Patent
Su

(10) Patent No.: US 6,592,009 B2
(45) Date of Patent: Jul. 15, 2003

(54) SWITCH VALVE STRUCTURE FOR LIQUID SPRAYER

(76) Inventor: Cheng-Yuan Su, P.O. Box No. 6-57, Chung-Ho City, Taipei Hsien 235 (TW)

( * ) Notice: Subject to any disclaimer, the term of this patent is extended or adjusted under 35 U.S.C. 154(b) by 0 days.

(21) Appl. No.: 09/814,742

(22) Filed: Mar. 23, 2001

(65) Prior Publication Data

US 2002/0134799 A1 Sep. 26, 2002

(51) Int. Cl.[7] ..... B65D 88/54
(52) U.S. Cl. ..... 222/321.2
(58) Field of Search ..... 222/321.2, 321.7, 222/321.8

(56) References Cited

U.S. PATENT DOCUMENTS 3,331,559 A * 7/1967 Fedit ..... 239/333
4,113,145 A * 9/1978 Meshberg ..... 222/1
4,274,560 A * 6/1981 Cater ..... 222/321
5,894,963 A * 4/1999 Hirota ..... 222/321.2

* cited by examiner

*Primary Examiner*—Ehud Gartenberg
*Assistant Examiner*—Melvin Cartagena
(74) *Attorney, Agent, or Firm*—Troxell Law Office PLLC

(57) ABSTRACT

The invention herein relates to an improved switch valve structure for liquid sprayer comprises of a press body, a casing, a cylinder body, a piston body and a spring, wherein the piston body consists of a piston rod and a piston; a seal ring is disposed in the interior portion of the piston to be functioned together with the holes on the piston rod; a seal ring is also disposed on the outer edge of the piston to be worked with the cylinder body for inducing the liquid; the upper hollow portion of the cylinder body functions synchronously with the seal ring on the outer edge of the piston, while the projecting ring inside the lower portion of the cylinder functions synchronously with the solid body of the lower portion of the piston rod and the spring coiled around the lower solid portion of the piston rod.

1 Claim, 4 Drawing Sheets

SWITCH VALVE STRUCTURE FOR LIQUID SPRAYER

BACKGROUND OF THE INVENTION

1) Field of the Invention

The invention herein provides an improved switch valve structure for liquid sprayer by using the most compact configuration of components to achieve the function of spraying the liquid to enhance the economic effect.

2) Description of the Prior Art

Due to the progression of the modem times and the enhancement of the living standards, people concern more for convenient and practical devices of daily usages. Generally, most of the liquid sprayers for the containers of lotion or perfume use a pressable switch valve for spraying and releasing the lotion or the perfume for the user's convenient access.

The switch valve structure of the conventional liquid sprayer, as shown in FIG. 1, comprises a press body (11), a casing (12), a pump tube (13), a pump tube casing (14), a base tube (15), a spring (16), a steel bead (17) and a cylinder body (18), wherein the pump tube (13) is inserted at the groove hole (121) at the center of the casing (12) to connect the upper portion of the pump tube (13) with the press body (11); the lower end opening of the pump tube (13)is housed with a base tube (15) with small corresponding holes (151) on the two sides of the outer edges for the lotion or the perfume to be penetrated into the base tube (15) and covered by the pump tube casing (14); the bottom portion of the base tube is of a disc-shaped solid body; the steel bead (17) is mounted in the cylinder body (18) with the opening narrowing from the top to the bottom to make the diameter of the lower opening smaller than that of the steel bead (17); then the spring (16) will be disposed on the top of the steel bead (17); finally, the opening of the top edge of the cylinder body (18) will be housed to the bottom edge of the groove hole (121) of the casing (12) to make the bottom portion of the base tube (15) tightly press to the spring (16) and the lower end opening of the cylinder (18) house a induction tube (19).

As mentioned above, the user operates by first depressing the press body (11) to immediately spray the air in the container out of the nozzle (111) of the press body (11), at the mean time, due to the effect of cylinder suction, the lotion or the perfume in the sprayer enters the cylinder body (18) with the air via the induction tube (19); at this time, the elastic force of the spring (16) causes the bottom portion of the base tube (15) to press the steel bead (17) to block the opening of the cylinder body (18) defining a gap space between the base tube (15) and pump tube casing (14) to allow the lotion or the perfume in the cylinder body (18) to penetrate along the gap space towards the small holes (151) on the two sides of the outer edge of the base tube (15) and into the base tube (15), then allow the lotion or the perfume with the air to be sprayed outwards through the nozzle (111) of the press body (11) via the pump tube (13); when the press body (11) is released, the lotion or the perfume left in the cylinder body (18) will flow back accordingly into the sprayer.

From the foregoing section, although the structure design of the switch valve for liquid sprayer capable of achieving the spraying effect of the lotion or the perfume, the complicated components cause not only the difficulties in assembly and disassembly, but also increase the material costs and decrease the economic effect.

In view of the various shortcomings and inconveniences of the conventional liquid sprayers, the inventor of the invention herein, in the spirit of researching for the innovation and the best, based on the professional prospect and knowledge, has researched and designed an improved switch valve structure for liquid sprayer of less components, fast assembly, capable of reducing consumption, with more practical and wider applicable scopes and of more compatible value for manufacturing utilization.

SUMMARY OF THE INVENTION

The invention herein mainly comprises of a press body, a casing, a cylinder body, a piston body and a spring, wherein the piston body consists of a piston rod and a piston; the upper portion of the piston rod is hollow and the lower portion solid; a flange is mounted at the proper position around the outer edge of the upper portion for the piston rod to be inserted with the casing; the upper portion of the piston is housed with the press body to regulate the opening and the closure, whereat several holes are mounted at the proper positions on the lower portion of the flange to elevate the liquid to enter the rod; the closure of the holes is actually done by the covering of the piston; a seal ring is disposed in the interior portion of the piston to be functioned together with the holes on the piston rod; a seal ring is also disposed on the outer edge of the piston to be worked with the cylinder body for inducing the liquid; the upper hollow portion of the cylinder body functions synchronously with the seal ring on the outer edge of the piston, while the projecting ring inside the lower portion of the cylinder functions synchronously with the solid body of the lower portion of the piston rod and the spring coiled around the lower solid portion of the piston rod.

The primary objective of the invention herein is to use the assembly with less components of the press body, the casing, the cylinder body, the piston body and the spring to achieve the effect of spraying the lotion or the perfume inside the liquid sprayer. Furthermore, the inventor uses his ability of designing innovation by utilizing less elements than that of the conventional style to reduce the material costs and to enhance the economic effect.

To enable a further understanding of the effect, the structure and the features of the invention herein, the brief description of the drawings below is followed by the detail description of the preferred embodiment.

DETAILED DESCRIPTION OF THE PREFERRED EMBODIMENT

Figure 1:
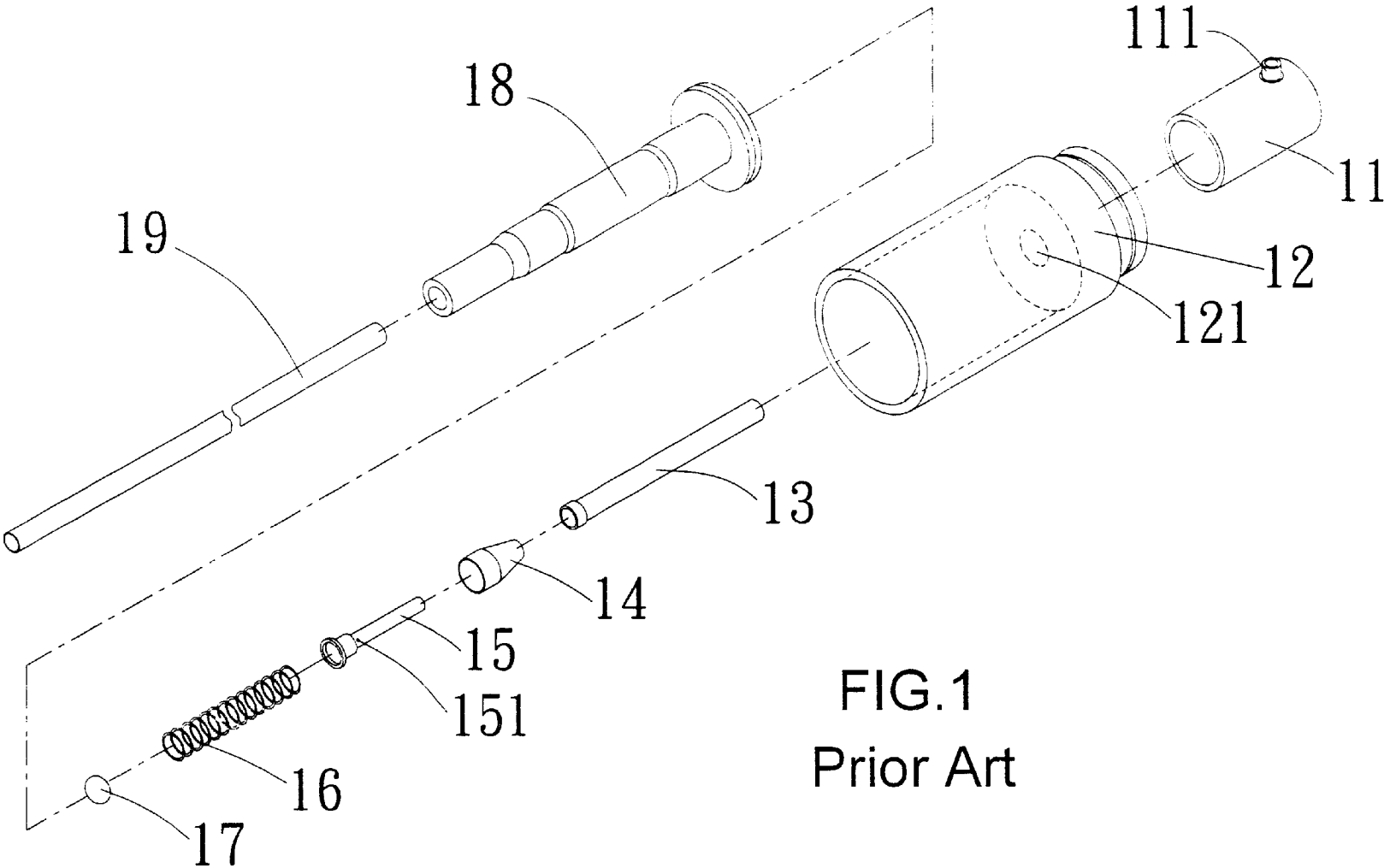
FIG.1 Prior Art
FIG. 1 is a pictorial and exploded drawing of a conventional liquid sprayer.
Figure 2:
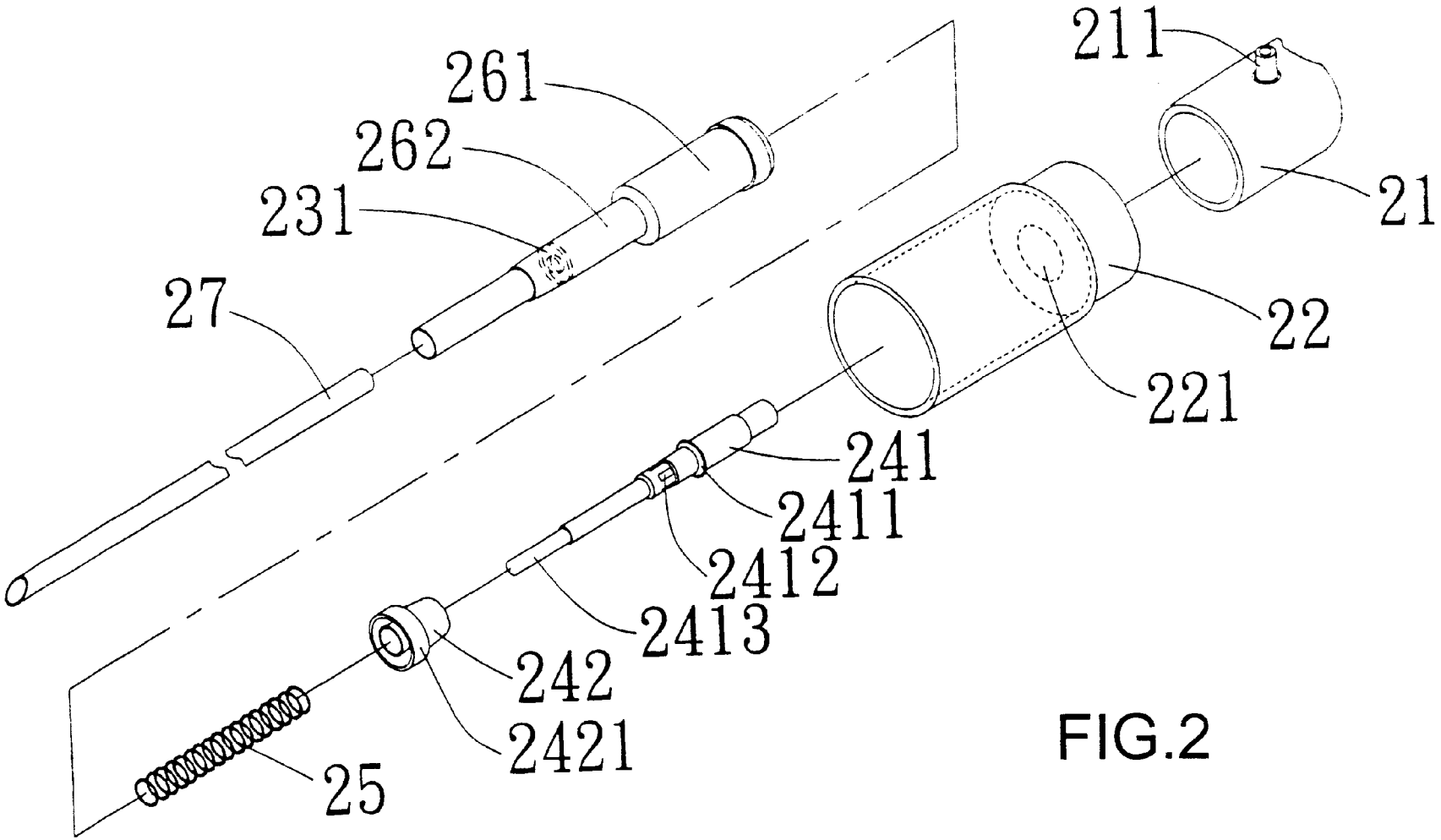
FIG. 2 is a pictorial and exploded drawing of the invention herein.
Figure 3:
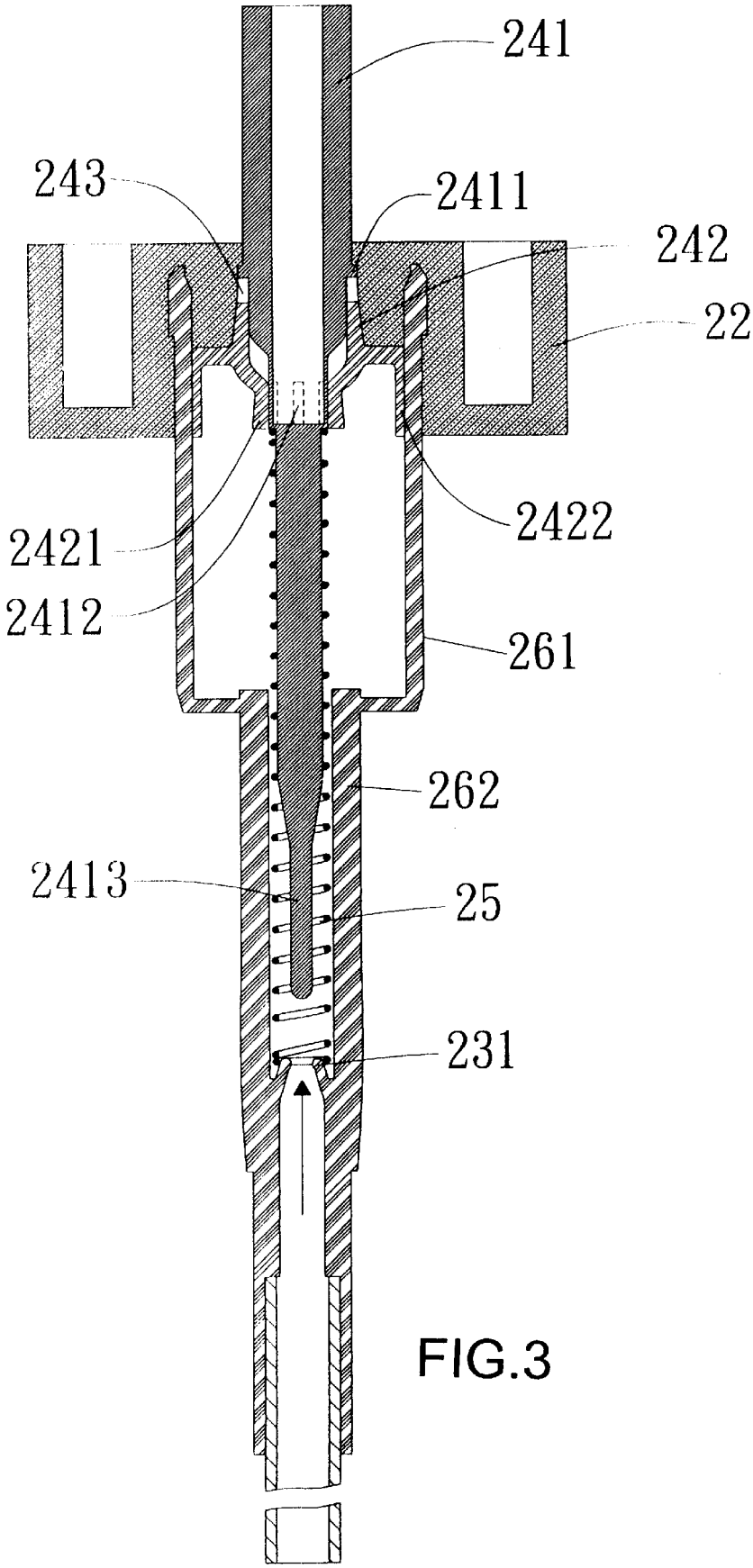
FIG. 3 is a cross-sectional view of the invention herein in original status.
Figure 4:
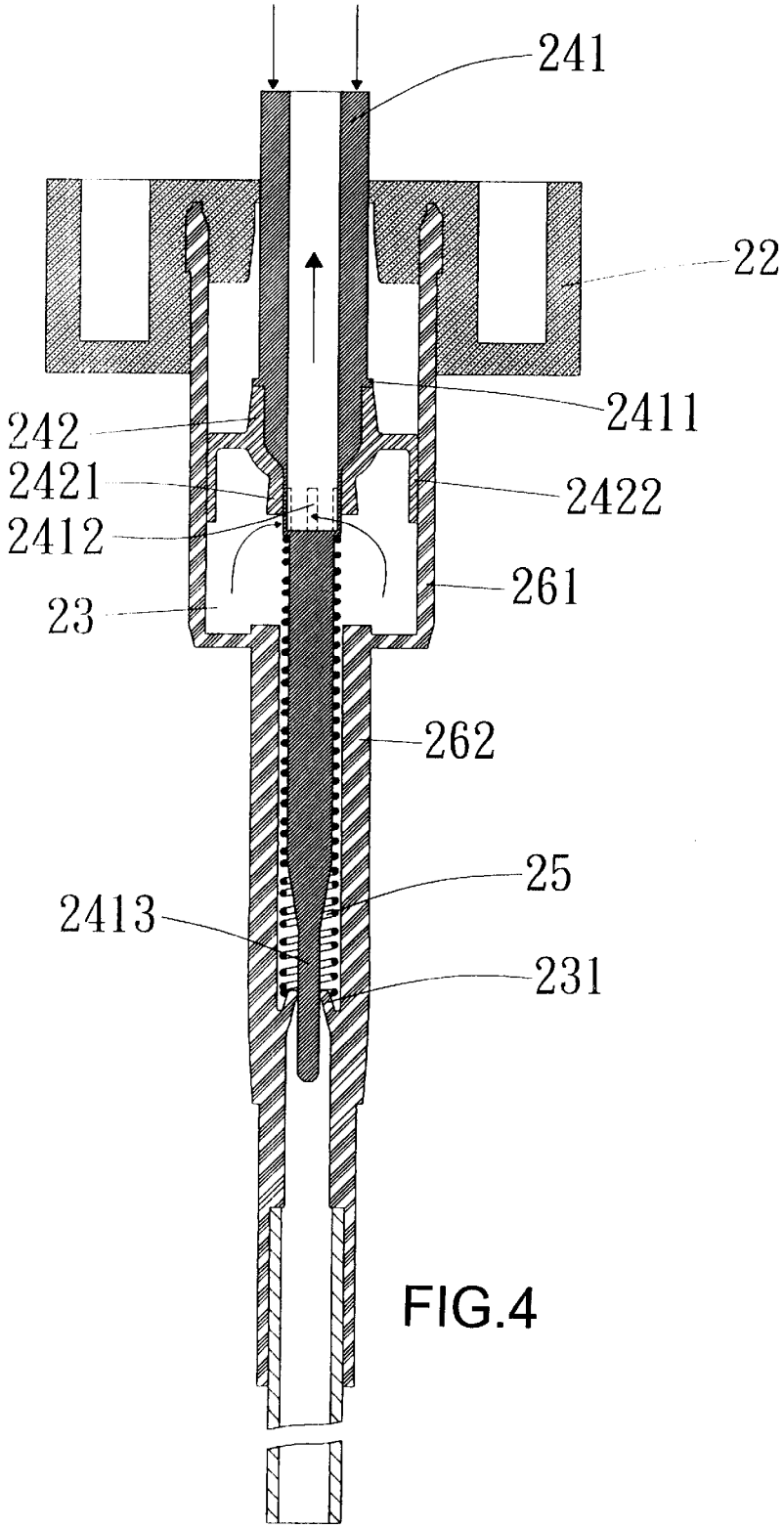
FIG. 4 is a cross-sectional view of the invention herein in depressed status.

Referring to FIGS. 2–4, the invention herein comprises a press body casing (22) a cylinder body (261), a piston (242) a piston rod (241) and a spring (25), wherein the cylinder body (261) is inserted in a groove hole at the center of the casing (22), the upper portion of the piston (242) is connected with piston rod (241) and a spring (25) is coiled around the lower portion of the piston rod (2413). Cylinder body (261) is connected with induction tube (27).

The piston assembly consists of a piston rod (241) and a piston (242), wherein the upper portion of the piston rod (241) is hollow and the lower portion (2413) solid; a flange (2411) is located at the proper position around the outer edge of the upper portion for the piston rod (241) to be inserted into the casing (22) for regulating the opening and the closure. Several holes (2412) are disposed below the flange (2411) to elevate the liquid to enter the piston rod. The closure of the holes (2412) is done by the covering of the piston (242). A first seal ring (2421) is disposed on the piston (242) to open and close the holes (2412) on the piston rod (241). A second seal ring (2422) is also disposed on the outer edge of the piston (242) in contact with the cylinder body (261). The upper hollow portion of the cylinder body (261) functions with the seal ring (2422) on the outer edge of the piston (242), while the projecting ring (231) in the lower interior portion (262) of the cylinder body (261) functions with the lower solid portion (2413) of the piston rod (241) and the spring (25) coiled around the lower solid portion (2413) of the piston rod (241). Therefore, the efficient liquid spraying can be achieved by the foregoing structure design of the components in the most compact configuration.

Referring to FIG. 3, as the user has not depressed the sprayer yet, the spring (25) is disposed against the edge of the projecting ring (231) inside the lower portion (262) of the cylinder body (261), the lower solid portion (2413) of the piston rod (241) is inserted in the spring (25), the first seal ring (2421) inside the piston (242) blocks the holes (2412) on the piston rod (241) in the upper hollow portion inside the cylinder body (261), a gap (243) is formed between the piston (242) and the flange (2411) of the piston rod (241), and the lower solid portion (2413) of the piston rod (241) does not block the opening of the projecting ring (231).

Referring to FIG. 4, as the user operates the liquid sprayer, the press body (21) will depress the piston rod (241), the lower solid portion (2413) of the piston rod (241) will insert into the projecting ring (231) and block the opening of the projecting ring (231). The top of the piston (242) will bear against the flange (2411) of the piston rod (241) to open the holes (2412) previously covered by the first seal ring (2421), then allow the lotion or the perfume inside the cylinder body (23) to flow into the piston rod (241) through the holes (2412), then spray out with the air through the nozzle (211) of the press body (21). When the depression action is released, due to the elastic force of the spring (25), the holes (2412) will thereby be blocked by the first seal ring (2421) inside the piston (242), the lower solid portion (2413) of the piston rod (241) will thereby go back and open the projecting ring (231). At this time, the lotion or the perfume inside the container will again enter the cylinder body (261) through the opening of the projecting ring (231) via the induction tube (27) to make the cylinder body (261) full of lotion or perfume and back to the original status.

In summation of the foregoing section, the improved structure of the switch valve structure of the liquid sprayer of the invention herein capable of using the most compact configuration to achieve the expected purpose and efficiency with less components than that of the switch valve structure of the conventional liquid sprayer but more practical and economical value, has not yet been published or operated publicly.

However, this invention has been described and illustrated in one of the examples of the preferred embodiments of the invention herein, but not for limiting the scope of the specific embodiments thereof. It will be appreciated that various modifications other than those discussed above may be restored to without departing from the spirit or scope of the invention.

What is claimed is:

1. A valve assembly for a liquid sprayer comprising:

a) a casing;

b) a press body on the casing;

c) a cylinder body mounted on an interior of the casing and extending out of one end of the casing, the cylinder body including a lower interior portion with a projecting ring defining an opening;

d) a piston rod moved by the press body and movably mounted in the casing, the piston rod having a hollow upper portion with a plurality of holes through the piston rod communicating with the hollow upper portion, the piston rod having a solid lower portion with an elongated cylindrical upper segment and an elongated cylindrical lower segment, a diameter of the elongated lower segment being less than a diameter of the elongated upper segment, the elongated lower segment configured to engage the projecting ring and block the opening, and a flange extending outwardly from the hollow upper portion;

e) a piston movably mounted on the piston rod and located within the casing, the piston having an upper extremity, a first seal ring engaging the hollow upper portion of the piston rod and a second seal ring engaging the casing, the piston and piston rod being movable between a first position wherein: the flange of the piston rod is displaced from the upper extremity of the piston, thereby permitting relative movement between the piston rod and piston; the first seal ring closes the plurality of holes in the hollow upper portion of the piston rod; and the lower segment of the solid lower portion of the piston rod is completely displaced out of engagement with the projecting ring of the cylinder body; and a second position wherein: the piston rod moves relative to the piston until the flange engages the upper extremity of the piston thereby displacing the piston relative to the casing and displacing the first seal ring from the plurality of openings, thereby opening the plurality of openings; and wherein the lower segment of the solid lower portion of the piston rod engages the projecting ring to close the opening therein; and, f) a spring acting on the piston rod and piston to bias the piston rod and piston toward the first positions.

* * * * *